US006220496B1

(12) United States Patent
Hirai et al.

(10) Patent No.: US 6,220,496 B1
(45) Date of Patent: Apr. 24, 2001

(54) NAILING MACHINE

(75) Inventors: Shoichi Hirai; Akira Uno, both of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/527,303

(22) Filed: Mar. 16, 2000

(30) Foreign Application Priority Data

Mar. 18, 1999 (JP) ..... 11-073400

(51) Int. Cl.[7] ..... B25C 1/04
(52) U.S. Cl. ..... 227/130
(58) Field of Search ..... 227/130, 8, 156; 173/206, 208

(56) References Cited

U.S. PATENT DOCUMENTS 4,211,352 * 7/1980 Zilka ..... 227/130
4,736,879 * 4/1988 Yamada et al. ..... 227/130
4,907,730 * 3/1990 Dion ..... 227/8
5,259,465 * 11/1993 Mukoyama ..... 227/130
5,562,240 10/1996 Campbell ..... 227/130
5,850,961 * 12/1998 Braun et al. ..... 227/8

* cited by examiner

*Primary Examiner*—Scott A. Smith
(74) *Attorney, Agent, or Firm*—Sughrue, Mion, Zinn, Macpeak & Seas, PLLC

(57) ABSTRACT

A nailing machine is provided with a second accumulator chamber 20 capable of accumulating compressed air having a pressure higher than air pressure usable by a machine body, an air intake 16 connectable to an air compressor via an air hose or the like, a valve 22 for control of the communication between the second accumulator chamber 20 and the air intake 16, and a pressure reducing valve 21 for reducing the compressed air pressure in the second accumulator chamber 20 and supplying the pressure-reduced compressed air into a first accumulator chamber 2.

8 Claims, 11 Drawing Sheets

NAILING MACHINE

BACKGROUND OF THE INVENTION

1. Field of the Invention

This invention relates to a nailing machine for driving in fasteners such as nails.

2. Description of the Related Art

FIGS. 14 and 15 show a conventional nailing machine. FIG. 14 shows an initial state of the nailing machine and FIG. 15 shows the nailing machine in operation.

As shown in FIG. 14, a machine body 1 includes an accumulator chamber 2 for accumulating compressed air, a cylinder 4, a piston 8 vertically movably supported in the cylinder 4, a drive bit 7 integrally formed with the piston 8, the lower end of which is used to drive in nails 6 positioned in an ejection portion 12, a return air chamber 3 that is provided on the lower outer periphery of the cylinder 4 and communicates with the interior of the cylinder 4 via an air passage 11 having a check valve, a main valve 5 vertically movably provided above the cylinder 4, a trigger valve 14 for providing and withholding the communication between a main valve upper chamber 15 and the accumulator chamber 2 via an air passage 9 and the like. Further, the accumulator chamber 2 is formed at the rear end of the body 1 and there is provided a handle portion 13 having an air intake 16 to which an air hose 50 connected to an air compressor (not shown) is connected. A trigger 17 for controlling a trigger valve 14 is also provided near the handle portion 13.

The air hose 50 connected to the air compressor is connected to the air intake 16 at the rear end of the handle portion 13, so that the compressed air is accumulated in the accumulator chamber 2.

FIG. 14 shows the nailing machine in the initial state in which compressed air is accumulated in the accumulator chamber 2 before the nailing operation is performed, the trigger valve 14 making the accumulator chamber 2 communicate with the main valve upper chamber 15 via the air passage 9.

While the main valve 5 stays in the lower position as shown in the drawing, the communication between the inside of the cylinder 4 and the accumulator chamber 2 is shut off and an exhaust vent 10 in the upper position of the cylinder 4 is opened. Thus, the upper portion of the piston 8 in the cylinder 4 communicates with the atmosphere and the piston 8 as well as the drive bit 7 in the cylinder 4 is in the elevated position.

When the trigger valve 14 is operated after the trigger 17 is actuated as shown in FIG. 15, the communication between the main valve upper chamber 15 and the accumulator chamber 2 is shut off. Then the compressed air in the accumulator chamber 2 causes the main valve 5 to ascend, which makes the inside of the cylinder 4 communicate with the accumulator chamber 2 and shuts the exhaust vent 10. The compressed air that has flowed into the upper portion of the piston 8 in the cylinder 4 causes the piston 8 and the drive bit 7 to descend rapidly within the cylinder 4, whereby the nail 6 positioned in the ejection portion 12 is hit before being driven into a workpiece 19.

At this time, the compressed air flows into the return air chamber 3 via the air passage 11 provided in the cylinder 4.

When the operation of the trigger 17 is released so as to make the main valve upper chamber 15 and the accumulator chamber 2 communicate with each other after the trigger valve 14 is returned to the initial state, the main valve 5 descends and the compressed air above the piston 8 in the cylinder 4 is discharged from the exhaust vent 10 into the atmosphere. The piston 8 and the drive bit 7 are caused to ascend by the compressed air in the return air chamber 3, and the nailing machine returns to the initial state shown in FIG. 14.

The conventional nailing machine operates as mentioned above and since the compressed air in the accumulator chamber 2 flows into the cylinder 4 and the return air chamber 3 during the nailing operation and since the compressed air that has flowed therein is discharged into the atmosphere, the pressure in the accumulator chamber 2 is reduced as the nailing operation continues. However, as the accumulator chamber 2 is communicating with the air compressor via the air intake 16 and the air hose 50 provided at the rear end of the handle portion 13, the compressed air is supplied from the air compressor when the pressure in the accumulator chamber 2 is reduced. Consequently, the accumulator chamber 2 always holds the air pressure needed to perform the nailing operation and this makes it possible for the nailing machine to perform the nailing operation.

The nailing operation is made possible by the compressed air supplied from the air compressor as long as the aforementioned conventional nailing machine is concerned; in other words, the nailing operation cannot be performed unless the nailing machine is connected to the air compressor. Consequently, the air hose 50 is indispensable to connecting the air compressor to the nailing machine, which results in poor workability because the nailing machine is limited by the length of the air hose 50, the installation place of the air compressor and so forth.

When the nailing work is done in a small place, for example, the disadvantage is that the air hose 50 becomes obstructive.

One of the ways of obviating the above disadvantage is as disclosed in Japanese Utility Model Publication 13499/1973 to provide a nailing machine using liquified gas within a detachable liquified gas storage tank in its body as a power source. Although restrictions depending on the length of the air hose and the installation place of the air compressor and so forth are not imposed, many storage tanks will have to be prepared beforehand if the amount of work is large because it is difficult to refill the used storage tank with the liquified gas.

Another way of solving the above problem is to provide a nailing machine using a secondary battery as a power source but its power output is smaller than what is available from the compressed air as a power source, moreover, it takes much time to charge the secondary battery.

SUMMARY OF THE INVENTION

An object of the present invention intended to obviate the aforementioned shortcomings is to provide a nailing machine which is usable while an air compressor is not connected thereto, offers excellent workability and can easily be filled up with compressed air.

The object above is accomplished by providing a nailing machine with a second accumulator chamber capable of accumulating compressed air having a pressure higher than air pressure usable by the machine body, an air intake connectable to an air compressor via an air hose, a valve for control of the communication between the second accumulator chamber and the air intake, and a pressure reducing valve for reducing the compressed air pressure in the second accumulator chamber and supplying the pressure-reduced compressed air into the first accumulator chamber.

DETAILED DESCRIPTION OF THE PREFERRED EMBODIMENTS

Figure 1:
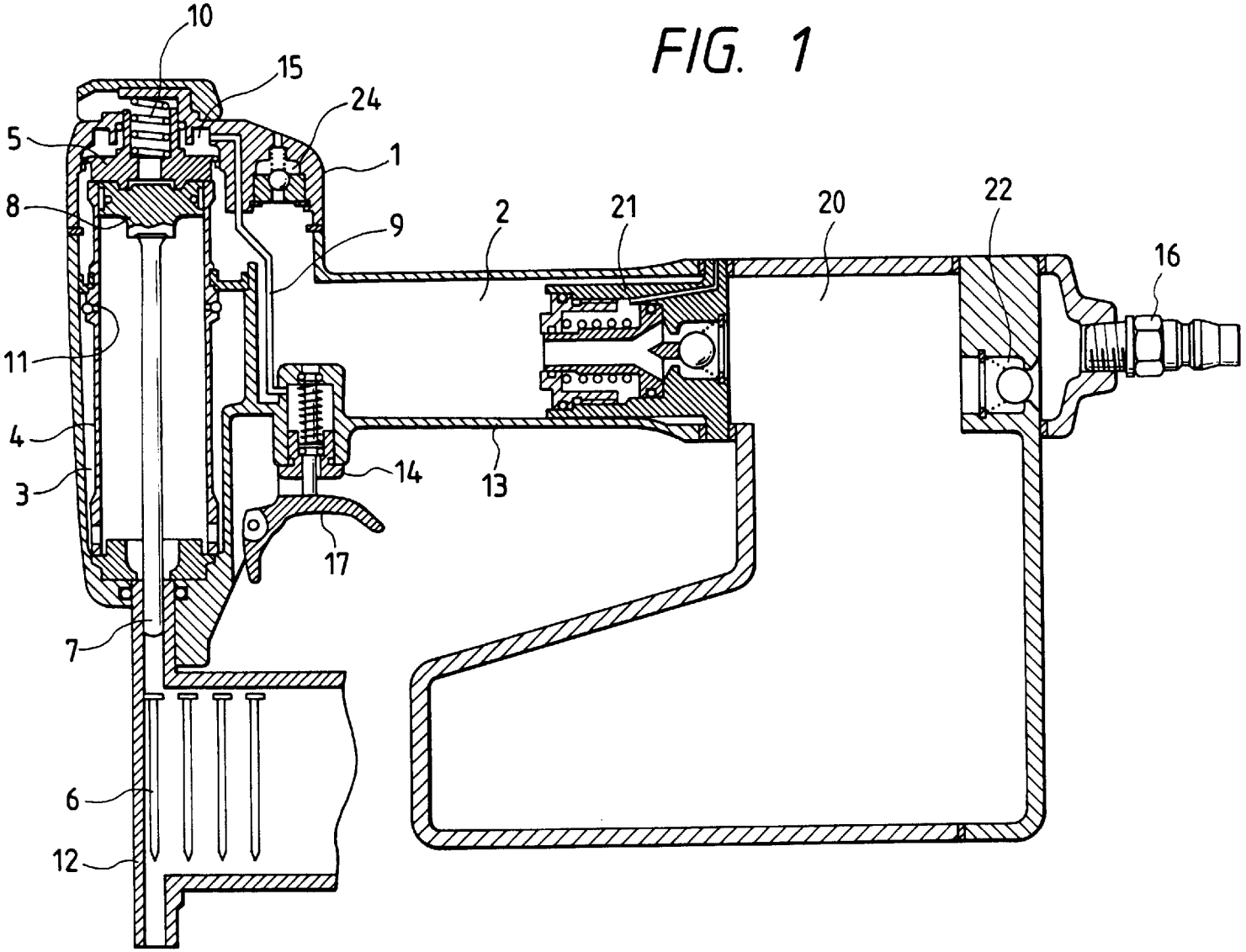
FIG. 1 is a sectional side view of a nailing machine embodying the present invention.
Figure 2:
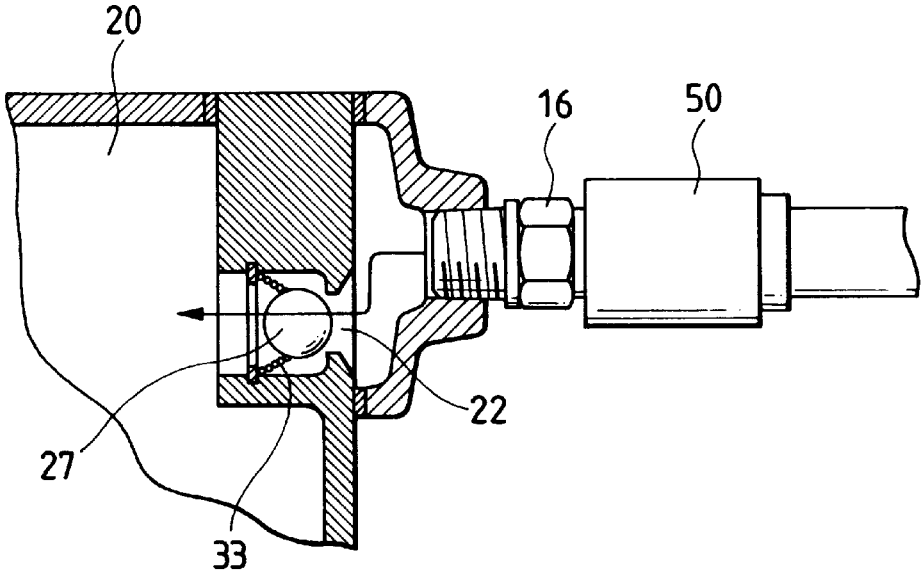
FIG. 2 is an enlarged view of the principal part of FIG. 1.

A nailing machine embodying the present invention will now be described with reference to FIGS. 1–5. As the nailing machine according to this embodiment of the invention performs a nailing operation similar to what is performed by the conventional nailing machine, like elements are given like reference characters and the description thereof will be omitted. Moreover, an accumulator chamber 2 provided in a handle portion 13 as in the conventional nailing machine is hereinafter called a first accumulator chamber 2.

As shown in the drawings, a second accumulator chamber 20 communicating with the first accumulator chamber 2, and an air intake 16 connectable to an air compressor via an air hose 50 are provided at the rear end of the handle portion 13 of a machine body 1. A pressure reducing valve 21 is provided between the first and second accumulator chambers 2 and 20, and a check valve 22 is provided between the second accumulator chamber 20 and the air intake 16.

The first accumulator chamber 2 used to accumulate compressed air to be consumed when nails are driven in has a pressure resistance strength equal to that of conventional nailing machines in general, the pressure resistance strength being sufficient to accumulate compressed air having a set pressure of about 8 Kgf/cm$^2$ according to this embodiment of the invention. On the other hand, the second accumulator chamber 20 used to accumulate the high-pressure compressed air supplied from the air compressor has not only a pressure resistance strength greater than that of the first accumulator chamber 2 but a volume capacity of one liter, the pressure resistance strength being sufficient to accumulate compressed air having a pressure of about 30 Kgf/cm$^2$ according to this embodiment of the invention. The two accumulator chambers 2 and 20 are coupled via a pressure reducing valve 21, so that the compressed air in the second accumulator chamber 20 is reduced in pressure and then introduced into the first accumulator chamber 2.

The check valve 22 provided between the second accumulator chamber 20 and the air intake 16 is essentially formed of an urethane ball 27 as a valve element, and a spring 33 for urging the urethane ball 27 so that the check valve 22 may always stay in the closed position. In a case where the pressure on the side of the air intake 16 is higher than that on the side of the second accumulator chamber 20, the urethane ball 27 moves toward the second accumulator chamber 20 against the urging force of the spring 33. The check valve 22 is then opened to have the compressed air from the air compressor supplied into the second accumulator chamber 20 via the air intake 16 and the check valve 22. In a case where the pressure on the side of the second accumulator chamber 20 is higher or substantially equal to that on the side of the air intake 16, the check valve 22 is shut to prevent the compressed air in the second accumulator chamber 20 from flowing toward the air intake 16.

A description will be given of a case when the air hose 50 connected to the air compressor is connected to the air intake 16.

The aforementioned operation of the check valve 22 causes the compressed air to be supplied from the air compressor into the second accumulator chamber 20 until the pressure in the second accumulator chamber 20 becomes substantially equal to the pressure on the side of the air intake 16. The compressed air accumulated in the second accumulator chamber 20 is supplied into the first accumulator chamber 2 via the pressure reducing valve 21 provided between the first accumulator chamber 2 and the second accumulator chamber 20.

Figure 3:
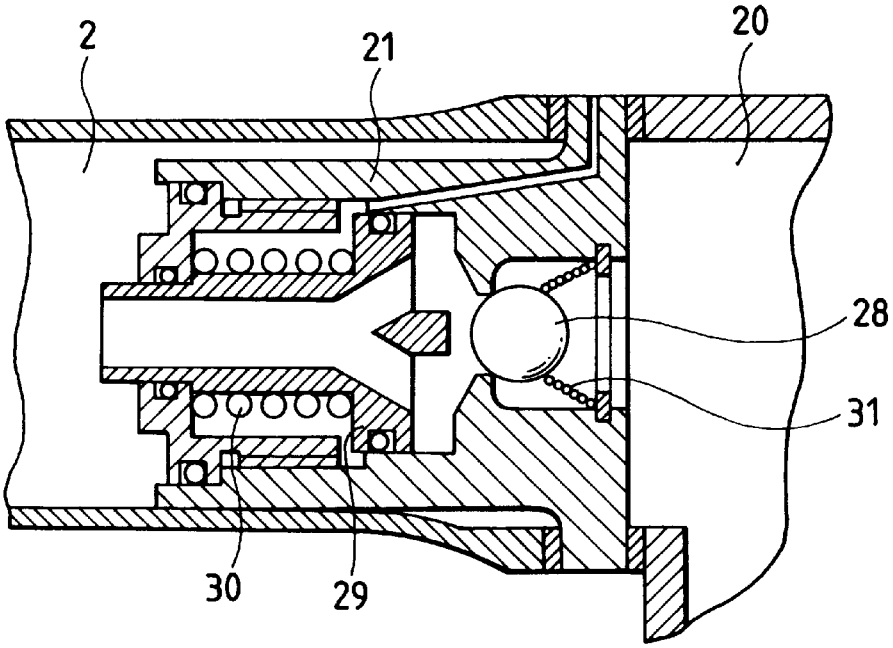
FIG. 3 is an enlarged view of the principal part of FIG. 1.
Figure 4:
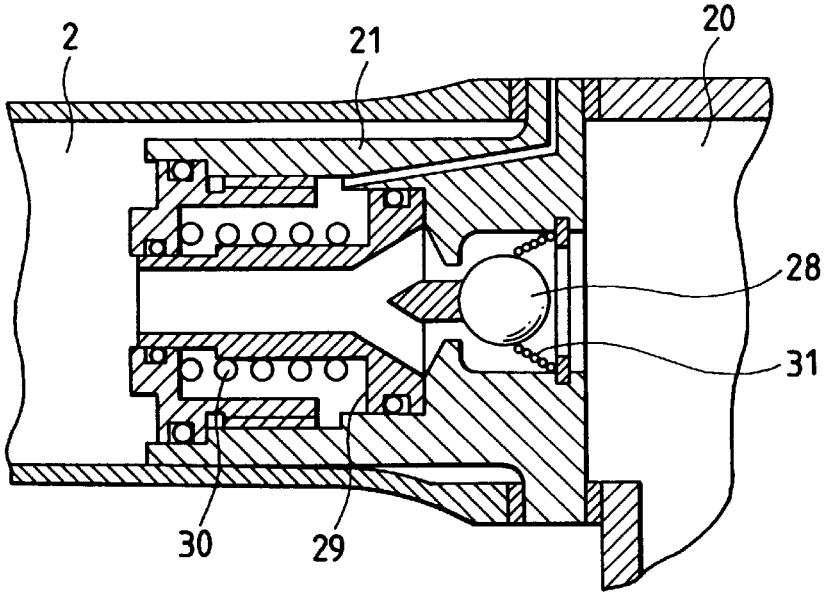
FIG. 4 is an enlarged view of the principal part, showing the operating condition of the pressure reducing valve shown in FIG. 3.

As shown in FIGS. 3 and 4, the pressure reducing valve 21 includes an urethane ball 28 for providing and withholding the communication between the first and second accumulator chambers 2 and 20, a spring 31 for usually urging the urethane ball 28 to make the urethane ball 28 shut off the communication between the first and second accumulator chambers 2 and 20, a regulator piston 29 for controlling the slidable urethane ball 28, and a spring 30 for urging the regulator piston 29. The regulator piston 29 is usually urged by the spring 30 to move toward the urethane ball 28 and to move away, that is, to the left as shown in the drawings from the urethane ball 28 by the compressed air in the first accumulator chamber 2.

The regulator piston 29 in the pressure reducing valve 21 shown in FIG. 3 becomes located on the left-hand side therein against the urging force of the spring 30, and the communication between the first and second accumulator chambers 2 and 20 is shut off. At this time, the set pressure (8 Kgf/cm$^2$ according to this embodiment of the invention) is maintained in the first accumulator chamber 2 and when the pressure in the first accumulator chamber 2 is maintained in the neighborhood of the set pressure, the regulator piston 29 slides away from the urethane ball 28 against the urging force of the spring 30.

When the pressure in the first accumulator chamber 2 is reduced as the nailing machine performs the nailing operation, the urging force applied to the regulator piston 29 because of the compressed air in the first accumulator chamber 2 becomes weaker than the urging force of the spring 30. The regulator piston 29 slides toward the urethane ball 28 and the end portion of the regulator piston 29 abuts against the urethane ball 28 as shown in FIG. 4. Then the regulator piston 29 makes the urethane ball 28 move against the urging force of the spring 31, so that the first and second accumulator chambers 2 and 20 communicate with each other.

When the compressed air in the second accumulator chamber 20 is supplied via the pressure reducing valve 21 into the first accumulator chamber 2 and when the pressure in the first accumulator chamber 2 rises to the set pressure, the regulator piston 29 remains in the state shown in FIG. 3, so that the communication between the first and second accumulator chambers 2 and 20 is shut off.

In other words, the pressure in the first accumulator chamber 2 is usually set at the set pressure through the operation of the pressure reducing valve 21 when the pressure in the second accumulator chamber 20 as the compressed air supply source of the first accumulator chamber 2 becomes higher than the set pressure in the first accumulator chamber 2.

When the air hose 50 is connected to the air intake 16, the compressed air having different predetermined pressure is accumulated in the second and first accumulator chambers 20 and 2, respectively. When the pressure in the first accumulator chamber 2 is reduced as the nailing machine operates, the compressed air in the second accumulator chamber 20 is supplied via the pressure reducing valve 21 into the first accumulator chamber 2. When the pressure in the second accumulator chamber 20 is reduced, the compressed air is supplied from the air compressor into the second accumulator chamber 20 via the air hose 50, the air intake 16 and the check valve 22, so that the different predetermined pressure is usually maintained in the first and second accumulator chambers 2 and 20, respectively.

Figure 5:
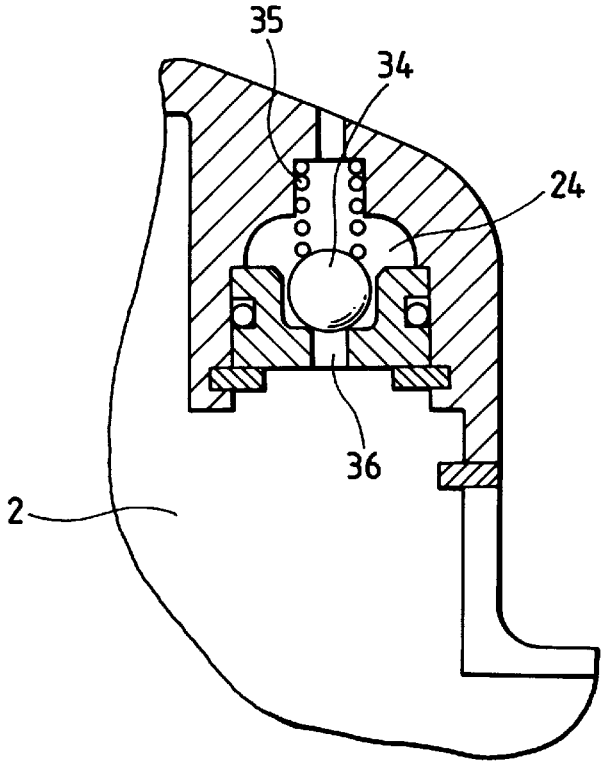
FIG. 5 is an enlarged view of the principal part of FIG. 1.

As shown in FIGS. 1 and 5, a relief valve 24 for controlling the communication between the first accumulator chamber 2 and the atmosphere is provided for the body 1. The relief valve 24 includes an urethane ball 34 and a spring 35 for usually urging the urethane ball 34 downward in FIG. 5 so as to shut off the communication between the atmosphere and the first accumulator chamber 2. While the pressure in the first accumulator chamber 2 is within the set pressure range, the urging force of the spring 35 causes the urethane ball 34 to shut off the communication between the atmosphere and the first accumulator chamber 2. When the pressure in the first accumulator chamber 2 exceeds the set pressure, the urethane ball 34 rises against the urging force of the spring 35 as shown in FIG. 5 and the first accumulator chamber 2 communicates with the atmosphere.

The relief valve 24 prevents the pressure in the first accumulator chamber 2 from exceeding the set pressure because the pressure reducing valve 21 provided between the first and second accumulator chambers 2 and 20 malfunctions, whereby to prevent the first accumulator chamber 2, and the cylinder 4, the piston 8 and the like in the following stage from being damaged.

The conditions under which the relief valve 24 operates are determined by the urging force of the spring 35 and the pressure receiving area of the urethane ball 34.

A case where the air compressor is disconnected from the nailing machine by detaching the air hose 50 from the air intake 16 will now be described. Incidentally, the pressure in the first and second accumulator chambers 2 and 20 is set at the different predetermined pressure by the compressed air supplied from the air compressor, respectively.

As the pressure in the second accumulator chamber 20 is higher than that in the first accumulator chamber 2, the compressed air in the second accumulator chamber 20 is supplied via the pressure reducing valve 21 into the first accumulator chamber 2 when the pressure in the first accumulator chamber 2 is reduced during the operation of the nailing machine.

Given that the set pressure in the first accumulator chamber 2 is 8 $Kgf/cm^2$ and that the pressure in the second accumulator chamber 20 is 30 $Kgf/cm^2$ with a capacity of one liter, the amount of the compressed air supplied into the first accumulator chamber 2 until the pressure in the second accumulator chamber 20 is reduced to the set pressure in the first accumulator chamber 2 when the air compressor is disconnected from the nailing machine will come to the following in terms of the atmospheric pressure.

$$(30-8)\times 1=22 \text{ (liters)}$$

Given that the amount of the compressed air consumed when the nailing machine drives in one nail is about 0.5 liter in terms of the atmospheric pressure, about 44 nails may be driven in.

When the pressure in the second accumulator chamber 20 is reduced to the set pressure or lower in the first accumulator chamber 2 after the nailing operation is repeated, the pressure reducing valve 21 opens to make both the accumulator chambers 2 and 20 communicate with each other. If the nailing operation is continued in this state, the pressures in both the accumulator chambers 2 and 20 are reduced simultaneously and sufficient output becomes unavailable ultimately and this makes it impossible to drive in nails.

In this case, the air hose 50 is connected to the air intake 16 again in order to refill the first and second accumulator chambers 2 and 20 with compressed air.

According to the above-described embodiment of the invention, the nailing operation is made performable without using the air hose and also usable in any given place with the effect of improving workability because the nailing operation range is not restricted by the length of the air hose 50 and a power source cord, the installation place of the air compressor and so forth. Workability is made improvable further as many nails can be driven in by the use of the small-capacity second accumulator chamber 20. Moreover, any ordinary air compressor is usable for the supply of air compressor into the second accumulator chamber 20, which obviates difficulties concerning the filling up of liquefied gas. As the accumulator chamber can be filled up with compressed air in a short time, it is unnecessary to prepare a plurality of liquified gas storage tanks beforehand, whereby workability becomes further improvable.

Figure 6:
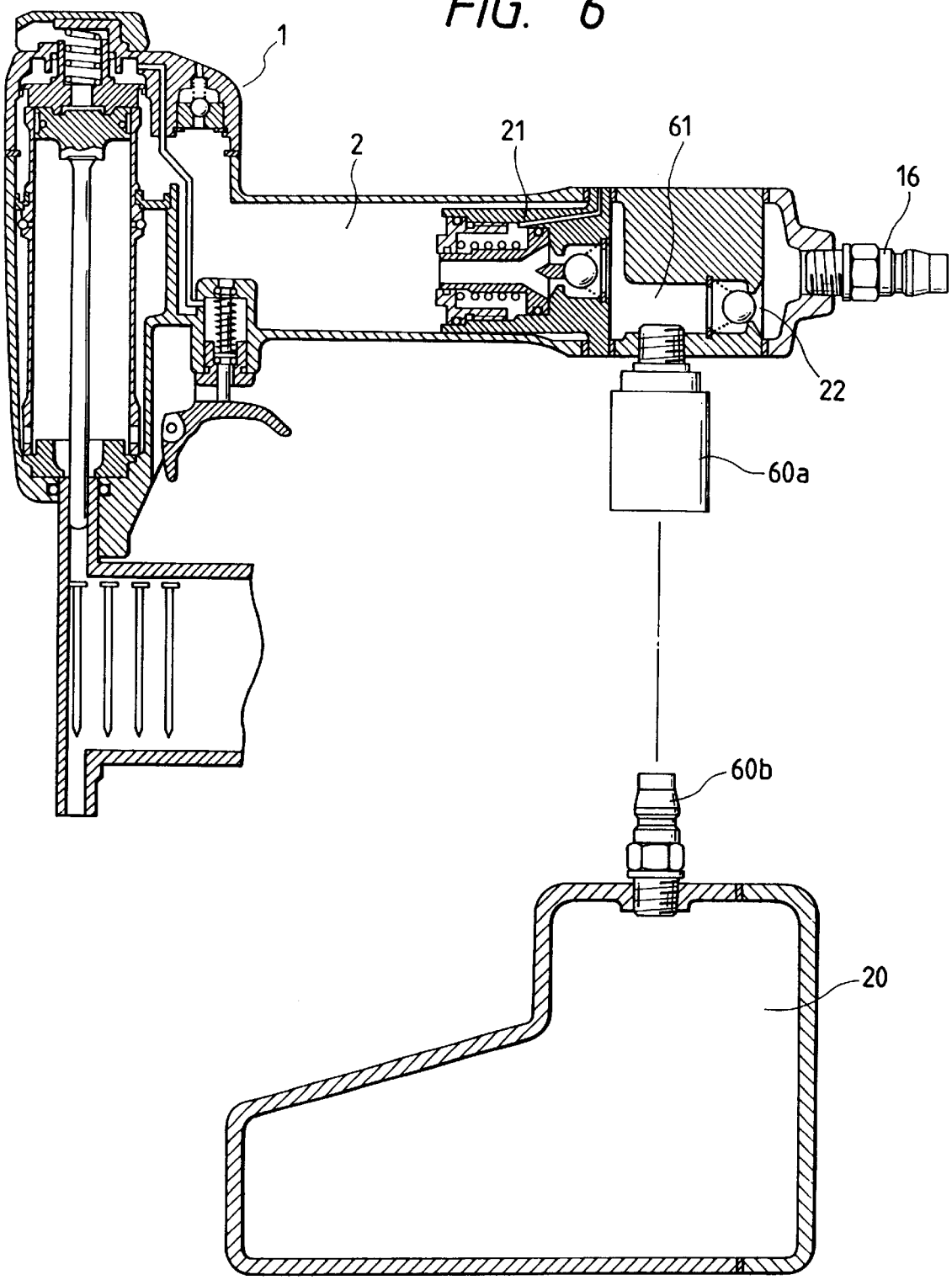
FIG. 6 is a sectional side view of another nailing machine embodying the present invention.
Figure 7:
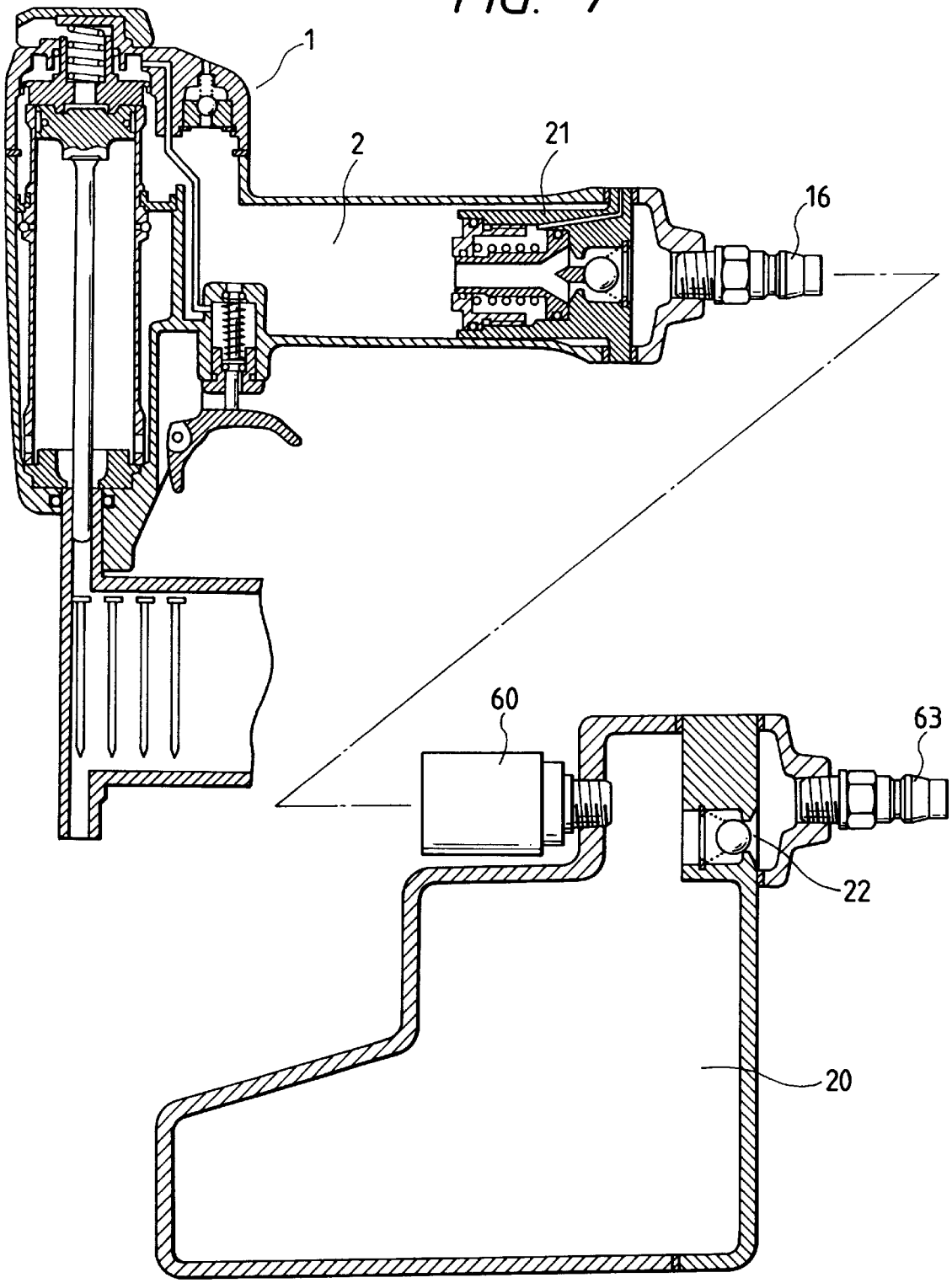
FIG. 7 is a sectional side view of still another nailing machine embodying the present invention.
Figure 8:
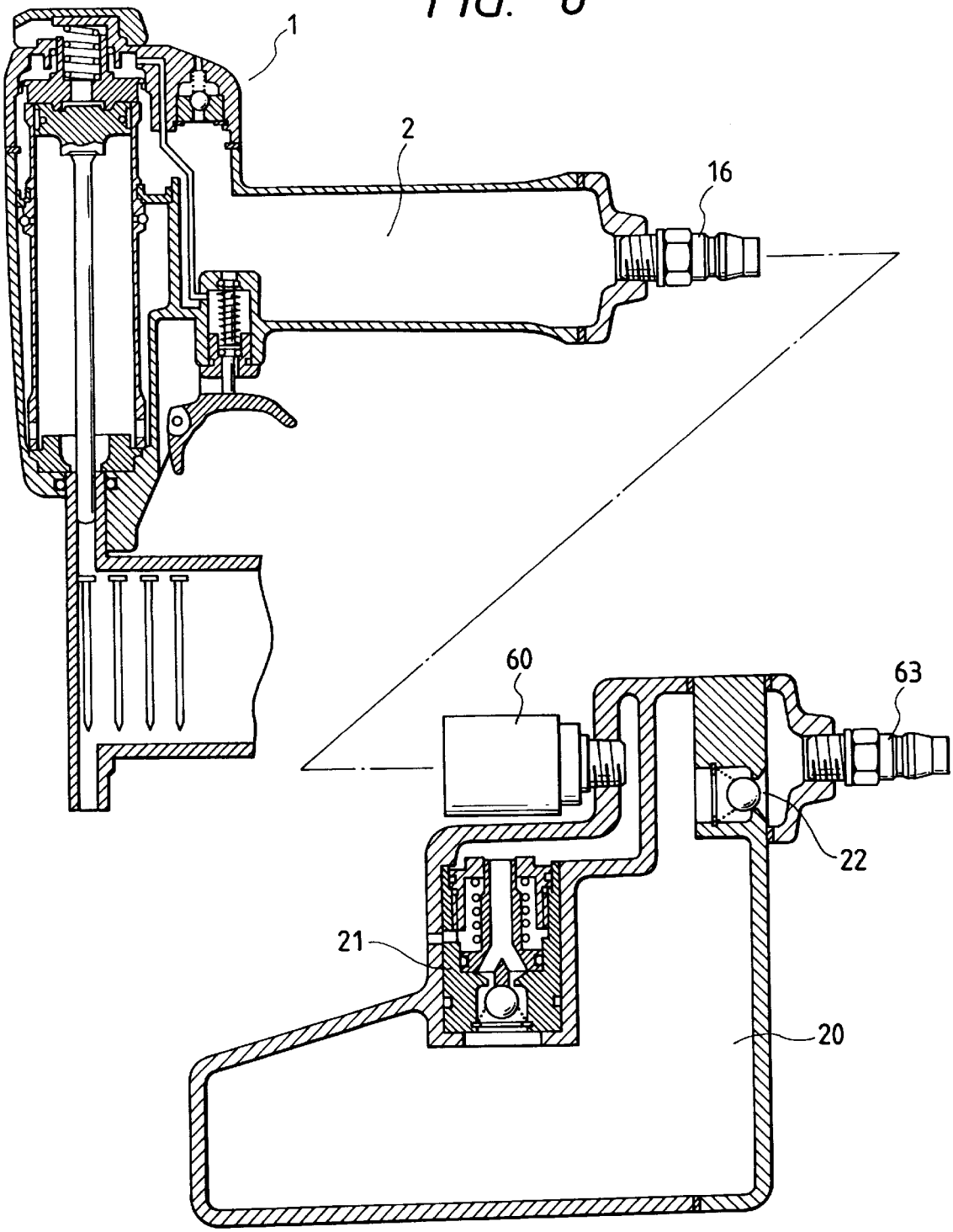
FIG. 8 is a sectional side view of still another nailing machine embodying the present invention.

FIGS. 6–8 show other examples of nailing machines according to the present invention.

As shown in FIG. 6, the second accumulator chamber 20 is attachable to the machine body 1 of a nailing machine having the air intake 16, the pressure reducing valve 21 and the check valve 22. Further, an air passage 61 is provided between the pressure reducing valve 21 and the check valve 22, and a loading-unloading device 60*a* for communicating with the air passage 61 is also provided.

The second accumulator chamber 20 is provided with an air intake 60*b* capable of engaging with the loading-unloading device 60*a* and by engaging the loading-unloading device 60*a* with the air intake 60*b*, the compressed air supplied from an air compressor via the air intake 16 and the check valve 22 is made to flow into the second accumulator chamber 20.

The second accumulator chamber 20 is capable of accumulating compressed air whose pressure is higher than the pressure in the first accumulator chamber 2 as in the aforementioned embodiment of the invention and when the second accumulator chamber 20 is disconnected from the air compressor, the compressed air in the second accumulator chamber 20 is reduced in pressure by the pressure reducing valve 21 before being supplied into the first accumulator chamber 2. Moreover, it is necessary to make such an arrangement that the loading-unloading device 60*a* provided for the body 1 is shut while it is not engaging with the air intake 60*b* of the second accumulator chamber 20 or when the pressure in the air passage 61 is higher than the pressure on the connection side of the air intake 60*b*.

The second accumulator chamber 20 may be disconnected from the body 1 of the nailing machine when work is done by connecting the air compressor thereto and as the second accumulator chamber 20 can thus be disconnected therefrom voluntarily, nonconformity arising from the presence of such a relatively large second accumulator chamber 20 can be obviated during the operation with the air compressor connected thereto.

FIG. 7 refers to an arrangement wherein the second accumulator chamber 20 is attachable to a nailing machine having the pressure reducing valve 21 within its body 1. The second accumulator chamber 20 is provided with a loading-unloading device 60 capable of engaging with the air intake 16, an air intake 63 similar in shape to the air intake 16 provided for the body 1, and the check valve 22, so that this arrangement is also proved effective in accomplishing the same operation/working effect as what has been described with reference to FIG. 6.

FIG. 8 refers to an example of making the second accumulator chamber 20 attachable to the prior art nailing machine, wherein the second accumulator chamber 20 is as shown in FIG. 8 provided with the air intake 63, the pressure reducing valve 21, and the loading-unloading device 60.

In this mode, the invention shown in FIG. 8 is applicable to the prior art nailing machine and the embodiment thereof is proved effective in accomplishing the same operation/working effect as what has been described with reference to FIG. 6.

FIGS. 9–13 show still other examples of nailing machines according to the present invention, wherein the compressed air in the second accumulator chamber 20 can be discharged into the atmosphere through the operation from the outside.

Figure 9:
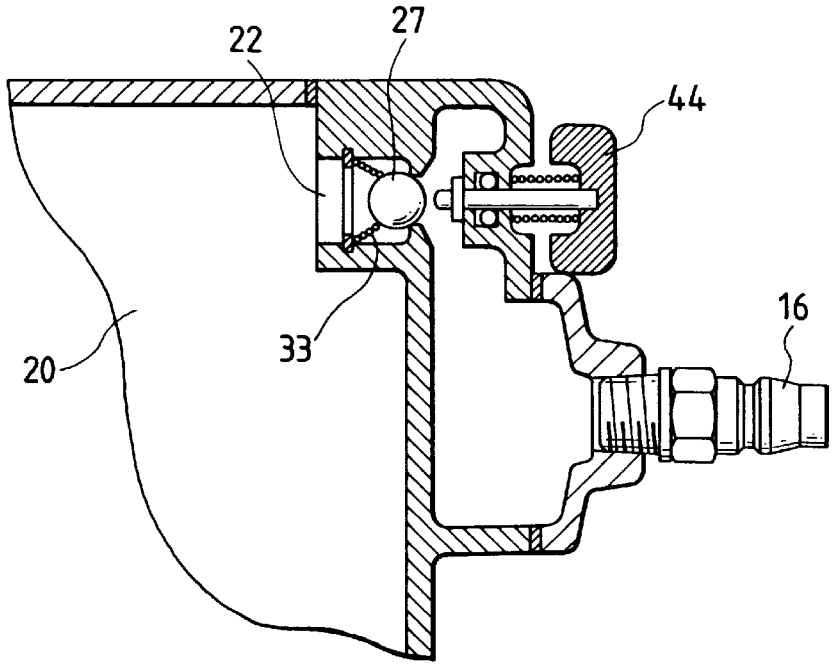
FIG. 9 is an enlarged sectional view of the principal part of still another nailing machine embodying the present invention.

FIG. 9 refers to an example of providing an operating element 44 for opening the check valve 22 so that the compressed air in the second accumulator chamber 20 can be discharged into the atmosphere via the check valve 22 and the air intake 16 by operating the element 44 after the termination of the work.

Figure 10:
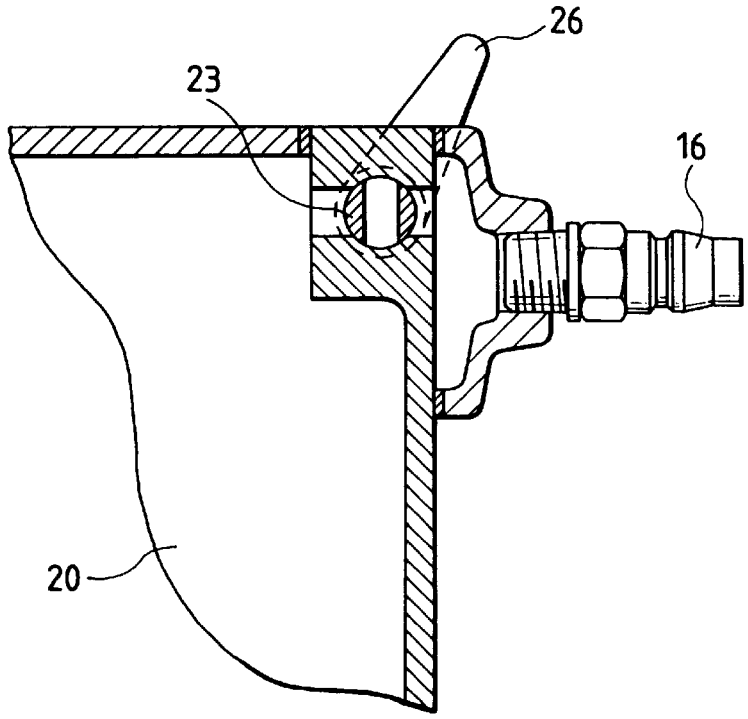
FIG. 10 is an enlarged sectional view of the principal part of still another nailing machine embodying the present invention.

FIG. 10 refers to an example of providing a discharge valve 23 having an operating lever 26 operable from the outside, in place of the aforementioned check valve 22. While the air hose 50 connected to the air compressor is connected to the air intake 16, compressed air is made to flow into the second accumulator chamber 20 by opening the discharge valve 23 by operating the operating lever 26. When the discharge valve 23 is opened while the air hose 50 is disconnected from the air intake 16, the compressed air in the second accumulator chamber 20 can be discharged into the atmosphere.

Figure 11:
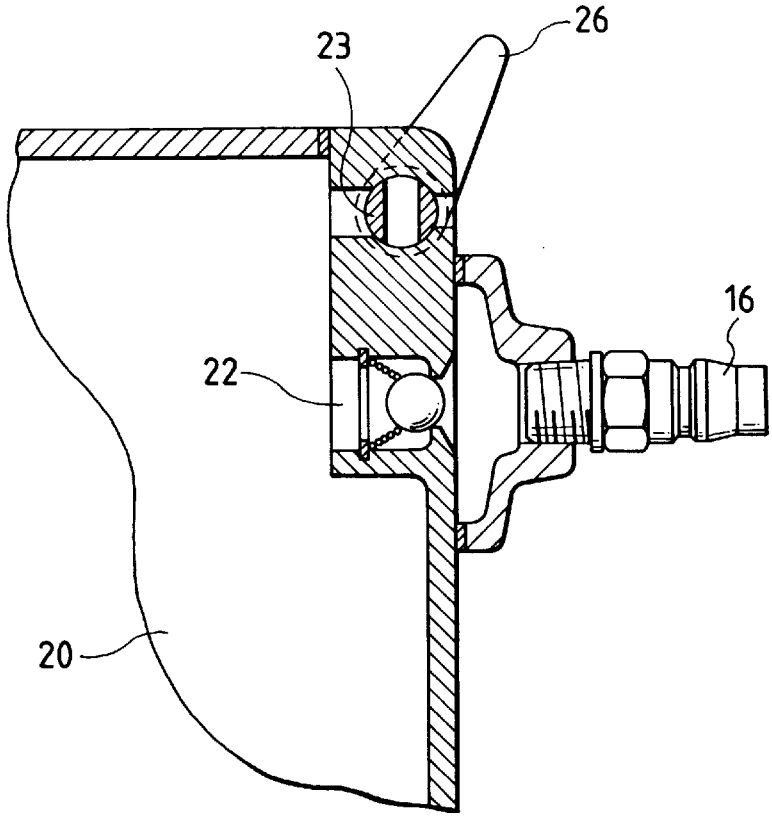
FIG. 11 is an enlarged sectional view of the principal part of still another nailing machine embodying the present invention.

FIG. 11 refers to an example of providing the discharge valve 23 that has the operating lever 26 operable from the outside and is capable of controlling providing and withholding the communication between the second accumulator chamber 20 and the atmosphere, the discharge valve 23 being installed in a place having no relation to the check valve 22. When the discharge valve 23 is opened by operating the operating lever 26, the compressed air in the second accumulator chamber 20 can be discharged into the atmosphere.

Figure 12:
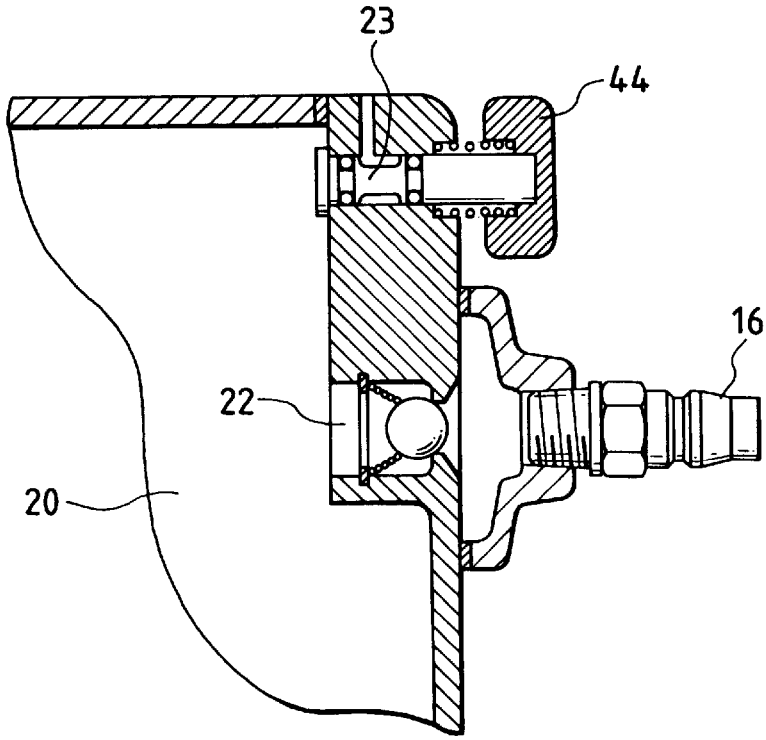
FIG. 12 is an enlarged sectional view of the principal part of still another nailing machine embodying the present invention.

FIG. 12 refers to an example of providing the discharge valve 23 that has the operating element 44 operable from the outside and is capable of controlling providing and withholding the communication between the second accumulator chamber 20 and the atmosphere, the discharge valve 23 being installed in a place having no relation to the check valve 22. When the discharge valve 23 is opened by operating the operating element 44, the compressed air in the second accumulator chamber 20 can be discharged into the atmosphere.

Figure 13:
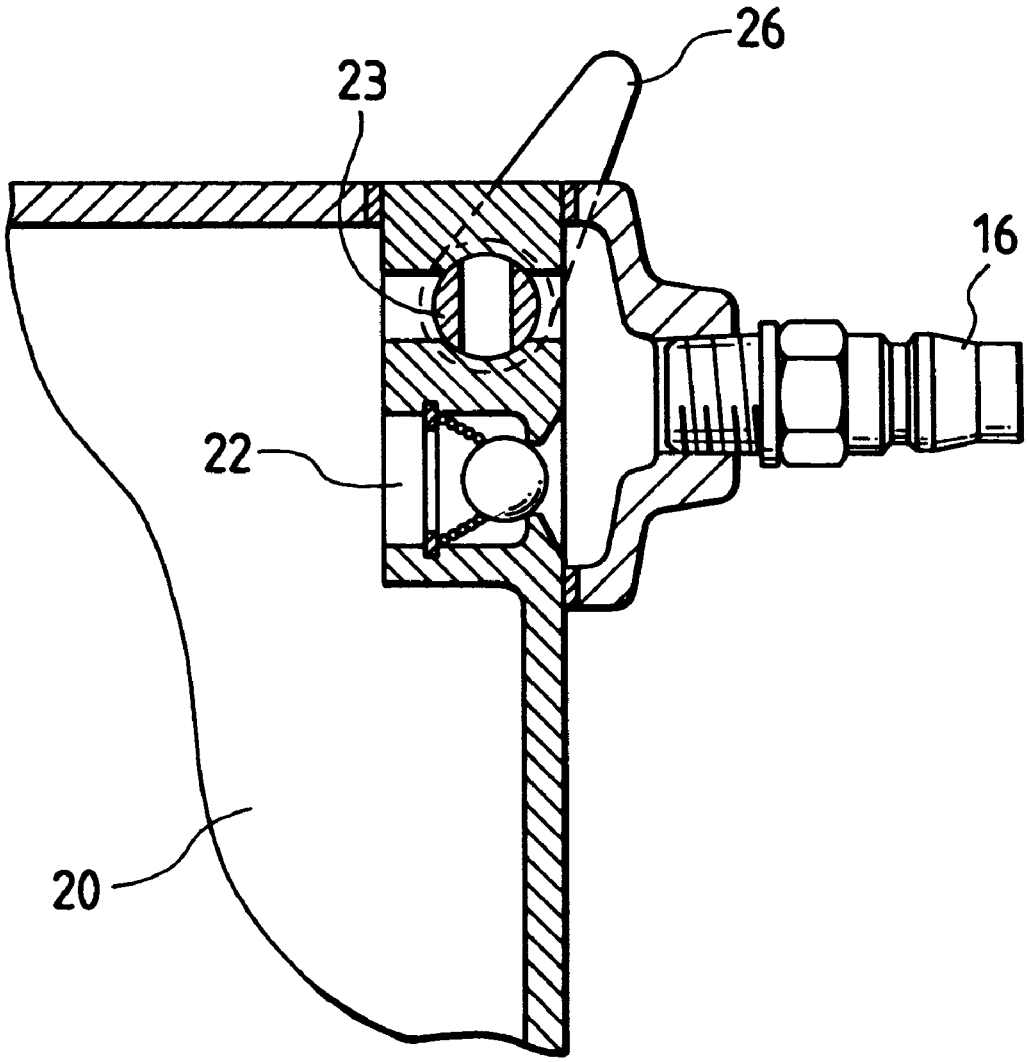
FIG. 13 is an enlarged sectional view of the principal part of still another nailing machine embodying the present invention.
Figure 14:
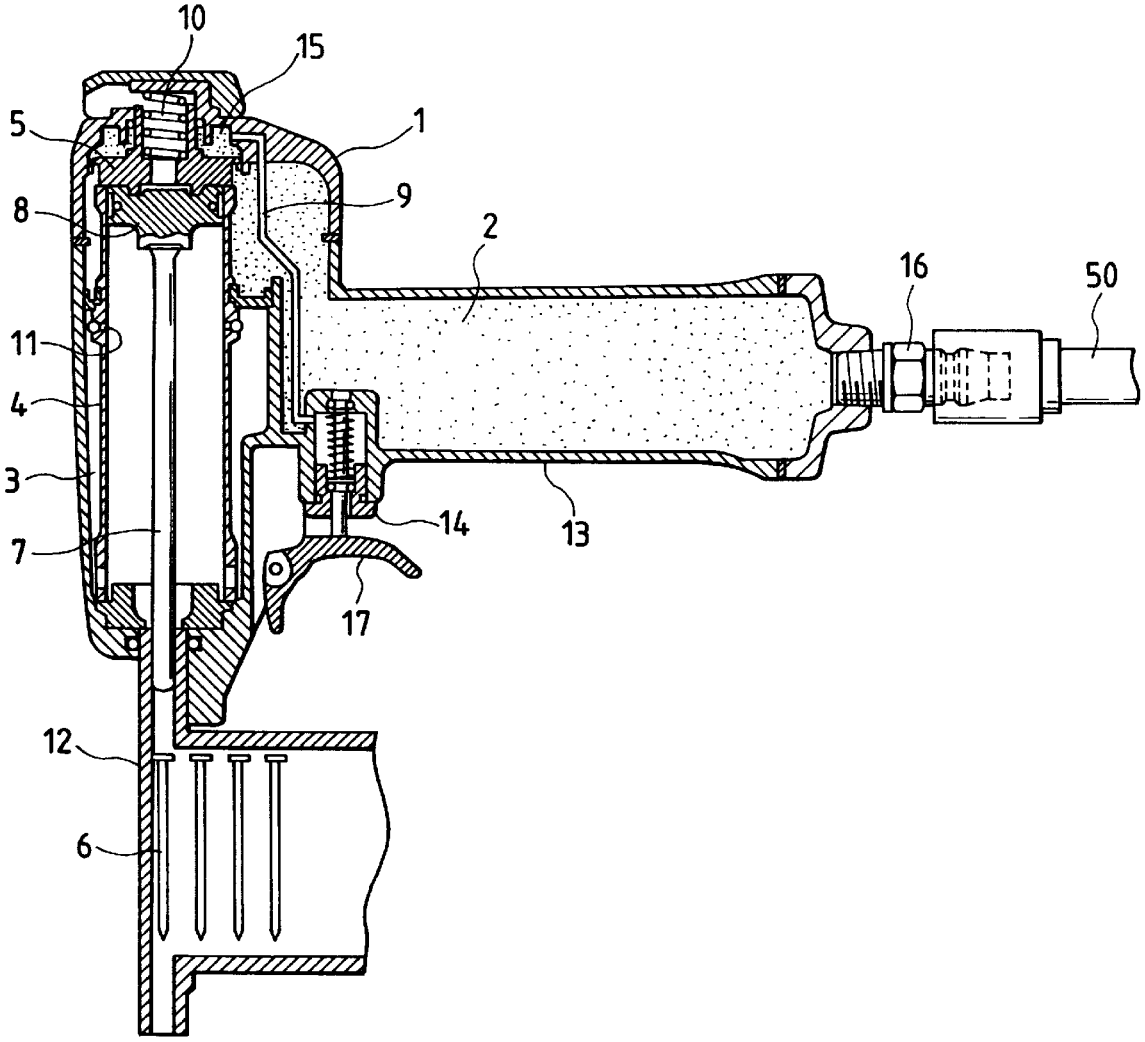
FIG. 14 is a sectional side view of an example of a conventional nailing machine.
Figure 15:
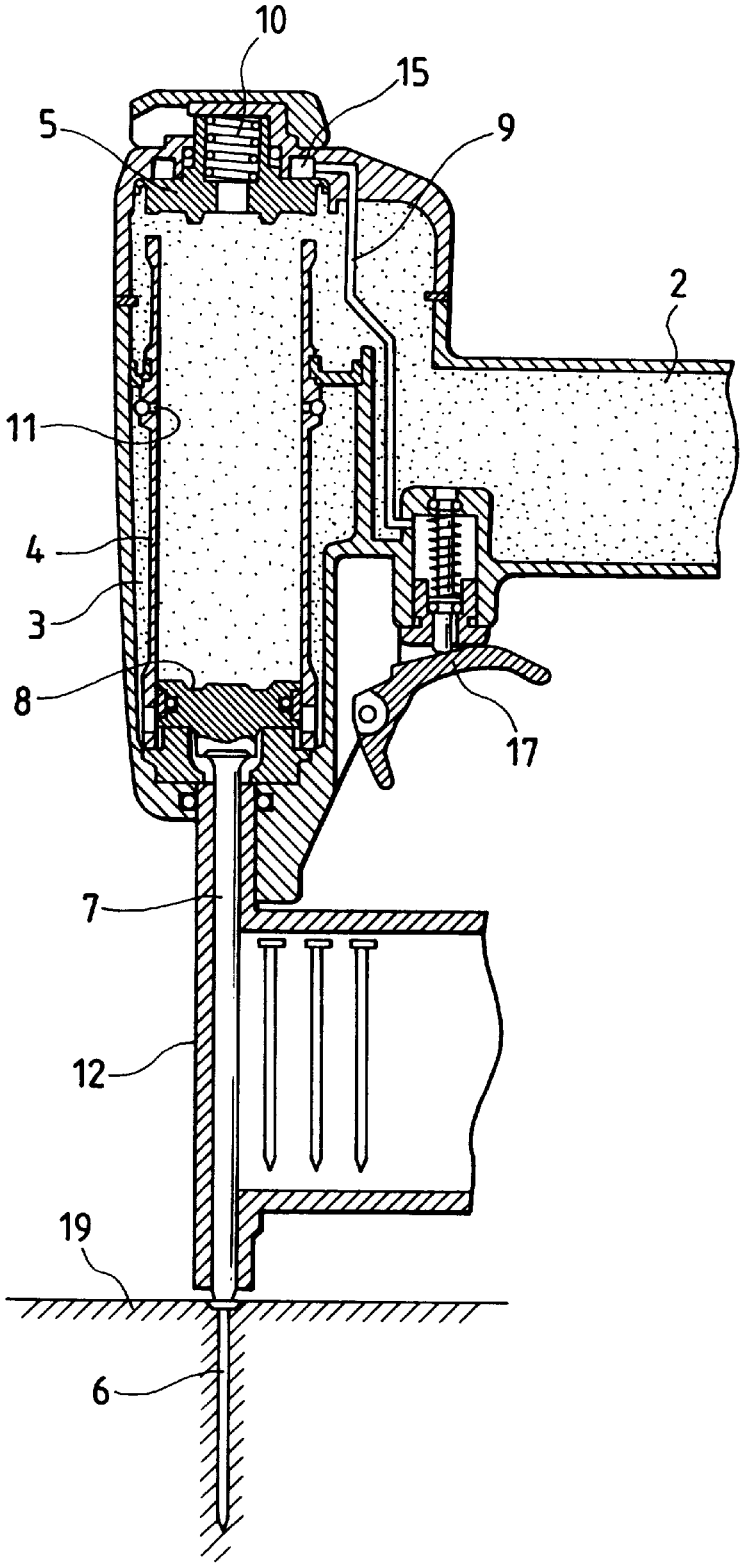
FIG. 15 is an enlarged side view of the principal part, showing the nailing condition of the nailing machine shown in FIG. 14.

FIG. 13 refers to an example of providing the discharge valve 23, in addition to the check valve 22, that has the operating lever 26 operable from the outside between the second accumulator chamber 20 and the air intake 16. When the discharge valve 23 is opened by operating the operating lever 26, the compressed air in the second accumulator chamber 20 can be discharged into the atmosphere via the air intake 16.

Although the inside of the second accumulator chamber 20 is made to communicate with the atmosphere in the examples shown in FIGS. 9–13 above, an arrangement may be made so as to make the inside of the first accumulator chamber 2 communicate with the atmosphere by providing the discharge valve 23 and the operating lever 26 or the operating element 44 shown in FIGS. 11 and 12 for the handle portion 13 of the body 1, for example. When the inside of the first accumulator chamber 2 is made to communicate with the atmosphere by operating the operating lever 26 or the operating element 44 in such an arrangement, the compressed air in the first accumulator chamber 2 is discharged into the atmosphere. However, the pressure in the first accumulator chamber 2 is reduced thereby and the compressed air in the second accumulator chamber 20 is caused to flow into the first accumulator chamber 2 via the pressure reducing valve 21 then. Consequently, the whole compressed air in the second accumulator chamber 20 will be discharged into the atmosphere ultimately via the pressure reducing valve 21 and the first accumulator chamber 2 if the inside of the first accumulator chamber 2 is made to communicate with the atmosphere by operating the operating lever 26 or the operating element 44. With this arrangement, the exhaust sound is reduced in comparison with a case where the compressed air in the high-pressure second accumulator chamber 20 is discharged into the atmosphere because the pressure of the compressed air that is discharged into the atmosphere is within the set pressure in the first accumulator chamber 2.

The nailing machine according to the present invention is provided with the second accumulator chamber capable of accumulating compressed air having a pressure higher than air pressure usable by the machine body, the air intake connectable to the air compressor via the air hose, the valve for control of the communication between the second accumulator chamber and the air intake, and the pressure reducing valve for reducing the compressed air pressure in the second accumulator chamber and supplying the pressure-reduced compressed air into the first accumulator chamber. Consequently, the nailing work can be done in such a state that the nailing machine has been connected to the air compressor and that it has been disconnected from the air compressor. It is thus possible to provide a nailing machine offering excellent workability as the nailing machine is usable while it is not connected to the air compressor with the air hose or the like and making the refilling of compressed air easier. Moreover, workability becomes improvable further because many nails 6 can be driven in by means of the small-capacity second accumulator chamber 20.

What is claimed is:

1. A nailing machine for driving in fasteners with a drive bit, comprising:

a cylinder;

a piston vertically movably provided in said cylinder;

a machine body;

a first accumulator chamber provided in said machine body accumulating a compressed air therein;

a second accumulator chamber which accumulates a compressed air having a pressure higher than an air pressure usable by said machine body;

an air intake;

a valve for control of the communication between said second accumulator chamber and said air intake; and a pressure reducing valve for reducing the compressed air pressure in said second accumulator chamber and supplying the pressure-reduced compressed air into said first accumulator chamber.

2. A nailing machine as claimed in claim 1, wherein said air intake, said valve and said pressure reducing valve are provided in said machine body, and said second accumulator chamber is detachably attached to said machine body.

3. A nailing machine as claimed in claim 1, wherein said air intake is provided in said machine body, and said valve and said pressure reducing valve are provided in a member having said second accumulator chamber, and said member is provided separately from the machine body.

4. A nailing machine as claimed in claim 1, wherein said valve is a check valve operating to prevent the compressed air in said second accumulator chamber from flowing out of said air intake.

5. A nailing machine as claimed in claim 4, wherein said check valve can be opened and closed by operating said check valve from the outside.

6. A nailing machine as claimed in claim 1, wherein a safety valve for making the inside of said first accumulator chamber communicate with the atmosphere when the pressure in said first accumulator chamber rises to a set pressure or higher is provided in the machine body.

7. A nailing machine as claimed in claim 1, wherein a discharge valve for making the inside of said first or second accumulator chamber communicate with the atmosphere is provided, said discharge valve being operable from the outside.

8. A nailing machine for driving in fasteners by striking the fasteners with a drive bit fitted to a piston by driving the piston in a cylinder, using compressed air in a first accumulator chamber provided in a machine body, wherein compressed air pressure in a second accumulator chamber which has accumulated compressed air having a pressure higher than air pressure usable by said machine body is reduced so as to supply the compressed air to said first accumulator chamber and wherein said piston is driven by the compressed air in said first accumulator chamber so that a number of fasteners can be driven in by the compressed air in said second accumulator chamber having a small capacity.

* * * * *